United States Patent [19]

Collins

[11] Patent Number: 5,024,011

[45] Date of Patent: Jun. 18, 1991

[54] DECORATIVE MESSAGE DISPLAY

[76] Inventor: Dane H. Collins, 2650 East South Fork Drive, Phoenix, Arizona 85044

[21] Appl. No.: 435,626

[22] Filed: Nov. 13, 1989

Related U.S. Application Data

[63] Continuation-in-part of Ser. No. 202,325, Jun. 6, 1988, Pat. No. 4,879,823.

[51] Int. Cl.[5] ..... G09F 1/00

[52] U.S. Cl. ..... 40/124.1; 446/220; 248/174; 248/539

[58] Field of Search ..... 248/27.8, 441.1, 451, 248/454, 459, 460, 121, 174, 176, 309.1, 314, 450, 534, 539; 40/124.1, 124; 446/220, 222, 223

[56] References Cited

U.S. PATENT DOCUMENTS

| | | | |
|---|---|---|---|
| 777,658 | 12/1904 | Bird | 248/441.1 |
| 1,742,854 | 1/1930 | Ferguson | 248/450 |
| 1,962,089 | 6/1934 | Davidson | 248/459 |
| 2,497,657 | 2/1950 | Cole | 248/473 |
| 2,635,386 | 4/1953 | Guischard | 446/223 |
| 3,250,241 | 5/1966 | Levy | 446/220 |
| 4,310,095 | 1/1982 | Fontlladosa | 248/460 |
| 4,547,167 | 10/1985 | Bergmann | 446/220 |
| 4,661,081 | 4/1987 | Basseches | 446/222 |
| 4,703,573 | 11/1987 | Montgomery | 40/124.1 |
| 4,813,902 | 3/1989 | Messer | 446/222 |
| 4,879,823 | 11/1989 | Collins | 446/222 |

FOREIGN PATENT DOCUMENTS

| | | | |
|---|---|---|---|
| 2817186 | 10/1979 | Fed. Rep. of Germany | 446/222 |
| 321798 | 11/1929 | United Kingdom . | |
| 376052 | 7/1932 | United Kingdom . | |
| 2019211 | 10/1979 | United Kingdom | 248/346 |

*Primary Examiner*—Carl D. Friedman
*Assistant Examiner*—Robert A. Olson
*Attorney, Agent, or Firm*—Don J. Flickinger; Jordan M. Meschkow

[57] ABSTRACT

A display apparatus includes a front panel having an image area and a message area. The front panel is either detachably coupled to or integrally formed with a horizontal base which maintains the panel in a substantially upright position. A plurality of decorative appendages, such as balloons, are coupled to first ends of a plurality of connectors. The other ends of the connectors are coupled to the front panel to complete the structure. If helium balloons are used, a counterweight may be provided for preventing the balloons from lifting the apparatus off the ground or tipping the panel forwardly. In one embodiment, a pressure-sensitive sound producing device may be embedded in the panel and covered by a selected image, so that the apparatus produces an audible message when the region of the image over the sound producing device is pressed.

3 Claims, 3 Drawing Sheets

DECORATIVE MESSAGE DISPLAY

This is a continuation-in-part of application Ser. No. 202,325, filed June 6, 1988, now issued as U.S. Pat. No. 4,879,823.

BACKGROUND OF THE INVENTION

This invention relates generally to greeting cards and, more particularly, to a free-standing message display including balloons and/or other decorative appendages and a kit for the assembly thereof.

The use of preprinted greeting cards has become widespread. As a matter of fact, it has become so common that very often times the recipient of a greeting card pays only casual attention to it, and the card is usually promptly discarded.

Recently, the sale of helium-filled balloon bouquets have become very common for the purpose of conveying messages of good cheer. Unfortunately, helium-filled balloons tend to deflate after six to eight hours, and therefore may be ineffective mechanisms for the transmission of long term messages.

SUMMARY OF THE INVENTION

It is an object of the present invention to provide a unique display apparatus which may be utilized to express messages.

It is a further object of the present invention to provide a kit which may be easily assembled to provide a unique display apparatus which will convey either a preprinted or personalized message.

According to a broad aspect of the invention there is provided a message display apparatus which comprises a front panel containing a preprinted or blank image portion and either a preprinted or blank message area. If blank, the user may write or print a desired message. A base is provided to which the front panel may be clipped or otherwise attached so as to support the front panel in an upright position. A plurality of balloons may be inflated and attached to the first ends of a plurality of rods, the second ends of which are secured to the front panel. The front panel and base are preferably made of a foam material such as polystyrene which allows for easy insertion of the free ends of the balloon bearing rods. The front panel may be punched from a pre-cut or perforated sheet of foam material. A second portion of the sheet may be utilized as the base.

In an alternately preferred embodiment, the front panel and the base are integrally formed of a rigid plastic. Sockets are formed in the front panel for receiving the free ends of the balloon bearing rods. A weight may be secured to the ends of the rods to prevent the balloons from lifting the panel and base into the air or from tipping forwardly.

In another embodiment of the invention, the front panel has a blank image portion over which the user may secure a photograph or cut-out picture of his or her own choosing. In addition, the panel may include a recess containing a pressure-sensitive device which produces a voice message or other sounds when the overlying picture is pressed.

In still another embodiment of the invention, instead of being inserted directly into sockets in the front panel, the free ends of the rods are received in a specially formed holder which is coupled to the panel.

In yet another embodiment of the invention, the front panel is snapped into a recess in the base, rather than being clipped on or integrally formed therewith. This allows the elements of the display device to be packaged in a flat configuration before assembly.

When provided in kit form, there is provided a sheet of suitable material, such as foam or cardboard, in which the front panel is cut or perforated. The base may also form a portion of the same sheet of material. Also provided are a plurality of balloons, rods to which the balloons may be secured, and means for attaching the base to the front panel. A permanent marker may also be included for writing or printing a custom message in the message area of the front panel. Other optional accessories may include a voice wafer for enabling the display device to produce sounds, weights for maintaining the front panel and base in a stable position, and a holder for coupling the balloon rods to the panel.

BRIEF DESCRIPTION OF THE DRAWINGS

The above and other objects, features and advantages of the present invention will be more clearly understood from the following detailed description taken in conjunction with the accompanying drawings, in which.

DETAILED DESCRIPTION OF THE PREFERRED EMBODIMENT

Figure 1:
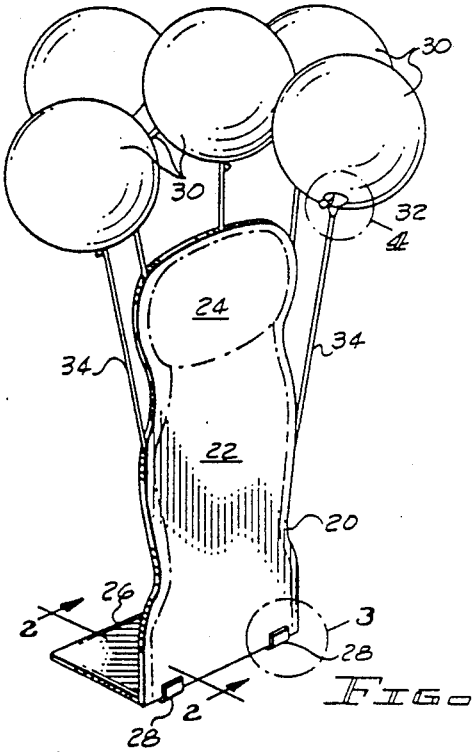
FIG. 1 is an isometric view of the inventive message display apparatus in assembled form.

FIG. 1 illustrates the inventive message display apparatus. As can be seen, the apparatus includes a front panel 20 having a desired shape and including an image area 22 and a message area 24. Either one or both of image area 22 and message area 24 may be preprinted or left blank so as to permit the sender to customize front panel 20 with his own message and/or image. Alternately, a message and image may be produced on the front surface of front panel 20 by, for example, printing, labeling, silk-screening, etc.

A base 26 is provided which when coupled along an edge thereof to the lower edge of front panel 20 as for example by clips 28, front panel 20 will be held in an upright position. Front panel 20 and base 26 are made of a foam material such as polystyrene and has a thickness of, for example, three-eighths of an inch.

A plurality of inflated balloons 30 are each coupled to a plastic balloon cup 32 which is in turn fixed on a first end of a rod 34. Rods 34 may be made of wood, acrylic, plastic, etc., and preferably have a diameter of approximately one-eight of an inch. The second or free end of rods 34 are easily inserted into the foam material of front panel 20.

Figure 2:
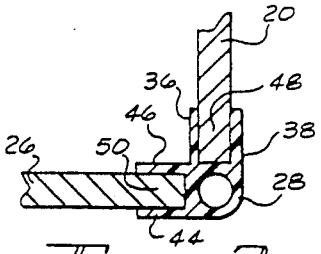
FIG. 2 is a cross-sectional view taken along the line 2—2 in FIG. 1 and illustrates how the base and front panel are clipped together to support the front panel in an upright position.
Figure 3:
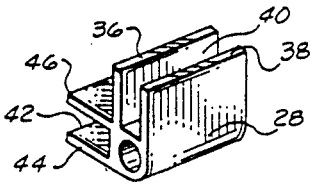
FIG. 3 is an isometric view of a clip which may be utilized to couple the base and front panel together.

FIGS. 2 and 3 illustrate in more detail clips 28 used for coupling base 26 to front panel 20. As can be seen, clip 28 is comprised of first and second substantially upright and parallel walls 36 and 38 forming a slot 40 therebetween. In a like manner, a generally horizontal slot 42 is formed by horizontal and rearward extending parallel walls 44 and 46. The lower edge 48 of front panel 20 is then inserted into slot 40 while the leading edge 50 of base 26 is inserted into slot 42. In this manner, the stability of base 26 is imparted to front panel 20 so as to maintain it in an upright position.

Figure 4:
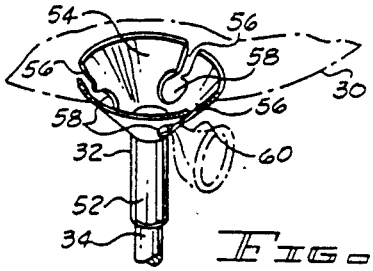
FIG. 4 illustrates a balloon cup to which an inflated balloon may be attached.

FIG. 4 illustrates in more detail the plastic balloon cups 32 shown in FIG. 1. As can be seen, each cup includes a hollow stem portion 52 for positioning on the upper end of rod 34. A funnel-shaped upper portion 54 is fixedly coupled to stem 52 and includes a plurality of slots 56 therein each of which terminates with a rounded portion 58. After balloon 30 (shown dotted in FIG. 4) is inflated, its neck portion 60 is brought down through one of the slots 56 and comes to reside in one of the rounded portions 58. Slot 56 and rounded portion 58 are sized so as to maintain neck 60 in a compressed constricted manner thus preventing air from escaping from the balloon. Thus, the inventive display apparatus has an extended life and is much more likely to be utilized for longer periods of time than mere greeting cards or helium-filled balloon bouquets.

Preferably, the image portion of front panel 20 may be approximately twenty-seven inches in width and forty inches in height. Balloons 30 may have printing or other images on their surface and may even be jeweled. It should also be noted that holes may be die-cut in front panel 20 to provide for easy insertion of the free end of rods 34 as is shown in connection with a further embodiment of the invention.

Figure 5:
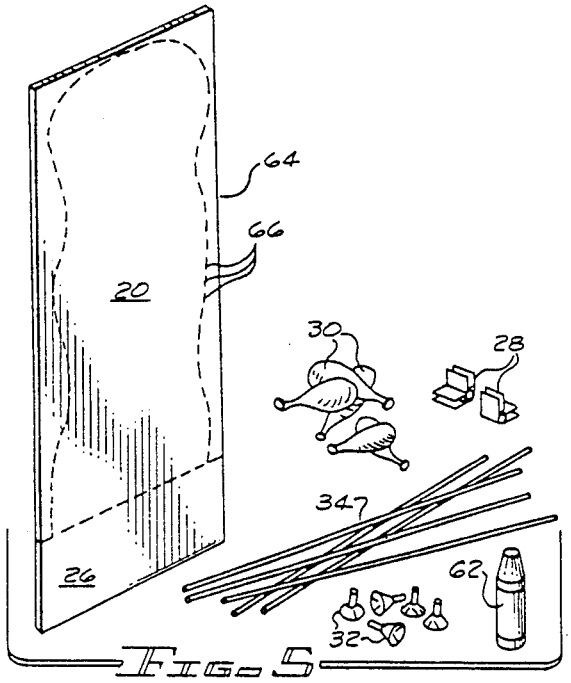
FIG. 5 illustrates the inventive message display apparatus in kit form.

The inventive display apparatus shown in FIG. 1 may be provided in kit form as is shown in FIG. 5. That is, the kit would include a plurality of balloons 30, first and second clips 38, a plurality of rods 34, a plurality of balloon cups 32 and a marker 62 for producing a message on the message area 24 of front panel 20. The kit would also include a rectangular piece of foam material 64 having a thickness of approximately three-eighths of an inch. Perforations 66 having been die-cut into foam material 64 correspond in outline to front panel 20. The bottom portion of rectangular sheet 64 corresponds to base 26.

Figure 6:
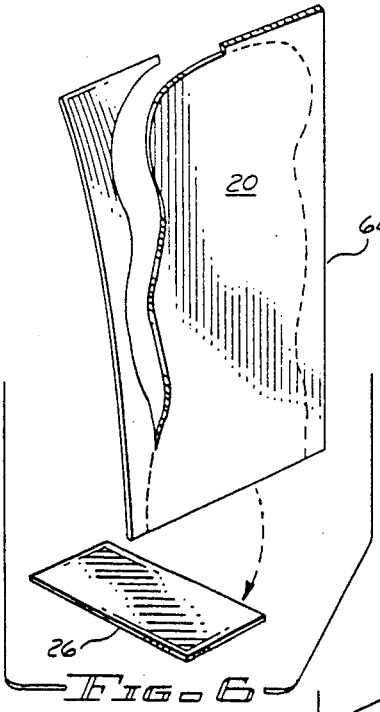
FIGS. 6, 7 and 8 illustrate the inventive message display apparatus in various stages of assembly.
Figure 7:
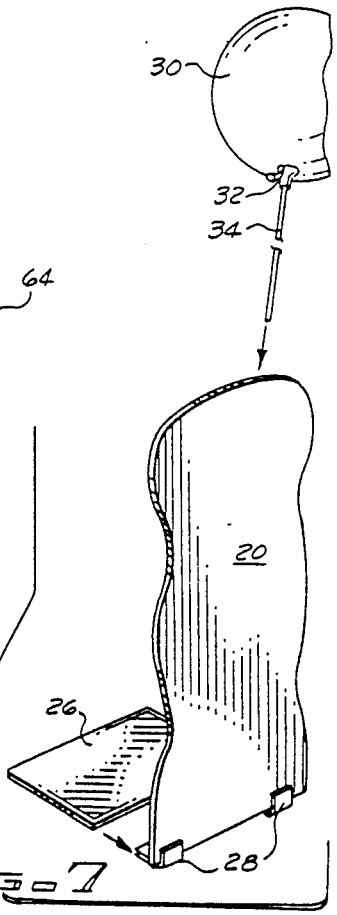

To assemble the inventive display apparatus, base 26 is first separated from the remainder of rectangular sheet 64, and front panel 20 is punched out as is shown in FIG. 6. Base 26 is then attached to front panel 20 by means of clips 28 so as to support front panel 20 in an upright position. Balloons 30 are inflated and attached to rods 34 by means of cups 32, and rod 34 is inserted into front panel 20 as is shown in FIG. 7.

Figure 11:
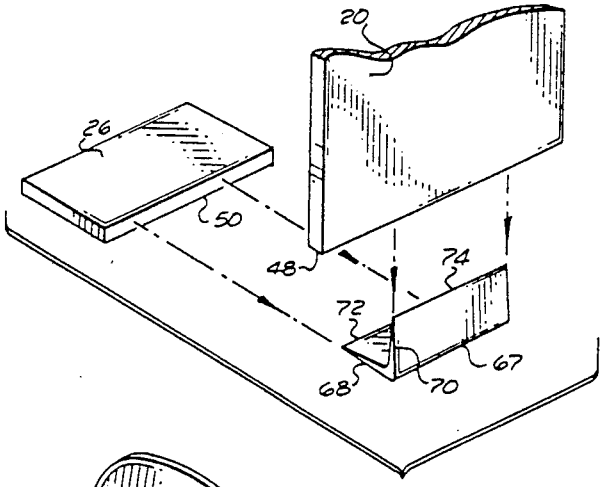
FIG. 11 illustrates an alternative technique for coupling the base and front panels so as to support the front panel in an upright position.

FIG. 11 illustrates an alternative form of clip 66 which may be used to couple base 26 to front panel 20. As can be seen, clip 66 comprises an angle bracket having first and second legs 68 and 70 each of which has a sharp edge 72 and 74, respectively. Leg 68 is caused to penetrate leading edge 50 of base 26 while leg 70 is caused to penetrate the bottom edge 48 of front panel 20.

Figure 8:
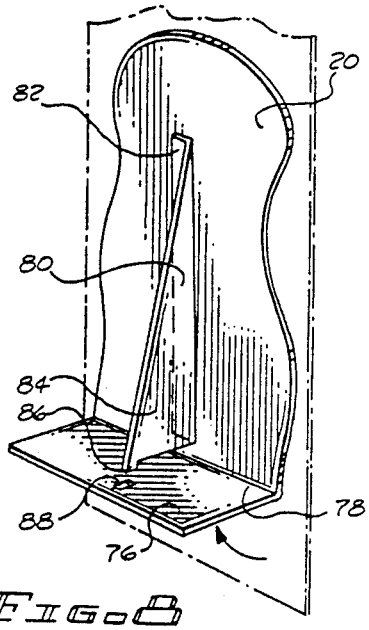

FIG. 8 illustrates yet an additional approach to maintaining front panel 20 in an upright position. In this case, a base portion 76 is integral with front panel 20 however folded at right angles with respect thereto along line 78. An easel member 80 is fixedly coupled as for example by gluing along a section 82 thereof to the back surface of front panel 20. An outwardly extending portion 84 is provided at its lower outer end with a protrusion 86 which may be matingly received within aperture 88 in base 76.

Figure 9:
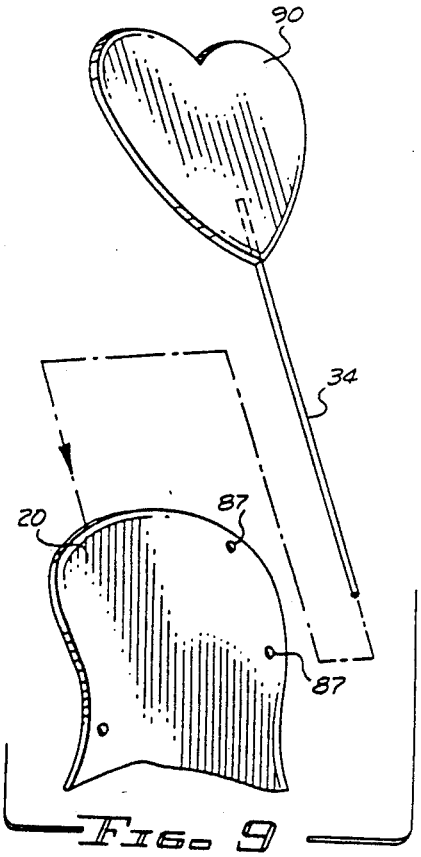
FIG. 9 illustrates the use of alternate decorative cutouts in place of balloons.

Referring now to FIG. 9, it can be shown that other forms of decorative cut-outs such as hearts 80 also made, for example, from a foam material such as polystyrene, may be fixed to one end of rod 34 while the other end of rod 34 penetrates the edge of front panel 20. As alluded to previously, holes 87 may be provided in front panel 20 into which the free end of rods 34 are inserted.

Figure 10:
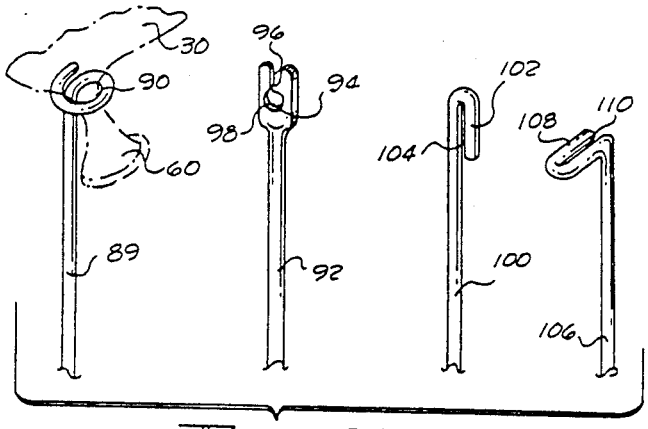
FIG. 10 illustrates alternate arrangements for securing an inflated balloon to an end of the rods.

FIG. 10 illustrates that the rods 34 may be terminated in such a manner so as to avoid the necessity for balloon cups 32. For example, rod 89 has an upper coil portion 90 which receives and constricts neck 60 of balloon 30 so as to prevent air from escaping therefrom. Rod 92 is provided with a flattened end portion 94 having a slot 96 therein which terminates with a rounded portion 98. This arrangement functions as did the slots 56 and rounded portions 58 in balloon cups 32 as shown and described in connection with FIG. 4. Rod 100 is bent back on itself such as is shown at 102 so as to form a slot 104. The neck of the balloon is then pulled into slot 104 which constricts it sufficiently so as to prevent air from escaping from the balloon. Finally, rod 106 has coupled to its end a U-shaped member 108 which extends substantially perpendicularly from rod 106. The U-shaped member 108 forms a slot 110 into which the neck of the balloon may be urged.

Figure 12:
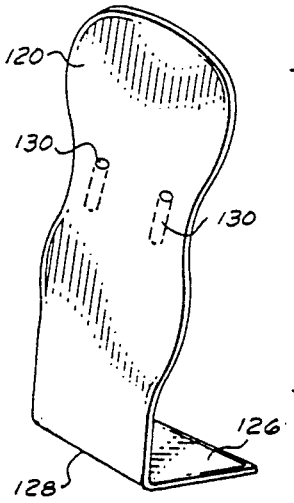
FIG. 12 illustrates an alternately preferred display apparatus in which the base and front panel are integrally formed of a rigid material.

It is within the scope of the instant invention that the front panel and the base are integrally formed of a rigid plastic, such as acrylic or acetate. With reference to FIG. 12 there is seen such an embodiment including front panel 120 and base 126 which are joined along fold 128. Sockets 130 formed into front panel 120 receive the lower ends of the rods 34.

One drawback of the arrangement shown in FIG. 12 is that the integrally formed panel 120 and base 126 may actually be lighter in weight than the balloons which are being displayed. If this is the case, the balloons may lift panel 120 and base 126 off the ground or tip the panel 120 so far forwardly that the device becomes unstable. One way of avoiding this problem is to very carefully select the position of sockets 130 so that the center of gravity of the device is relatively low.

Figure 13:
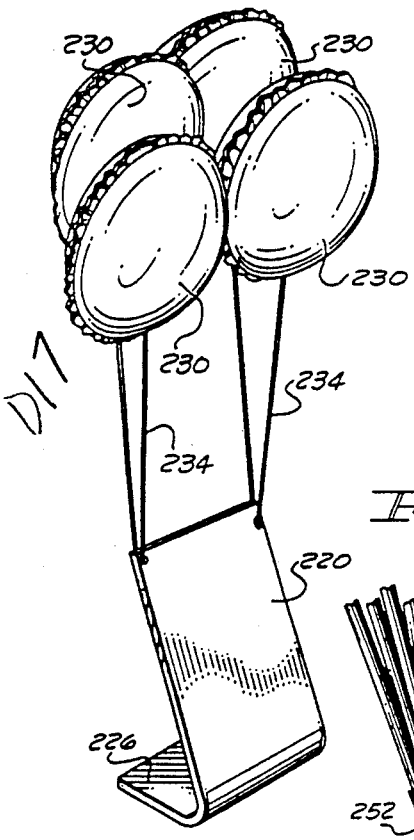
FIG. 13 illustrates another embodiment in which the base and front panel are integrally formed.
Figure 14:
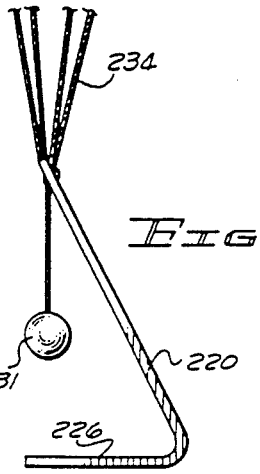
FIG. 14 is a side view of FIG. 13, showing a weight arrangement for maintaining the base and front panel in a stable position.

Another way of avoiding the problem of instability is shown in FIGS. 13 and 14. In this embodiment, front panel 220 and base 226 are again integrally formed. Front panel 220 forms an oblique angle with base 226. A plurality of helium-filled balloons 230 is arranged in two clusters, with each cluster of balloons 230 being secured, by means of strings or rods 234, to a different one of the two top corners of front panel 220. A counterweight 231 is suspended from the top edge of the front panel 220. The counterweight exerts a force on the panel 220 which is approximately equal in magnitude and opposite in direction to the force exerted on the panel 220 by the balloons 230, thus maintaining the device in a stable upright position.

Figure 15:
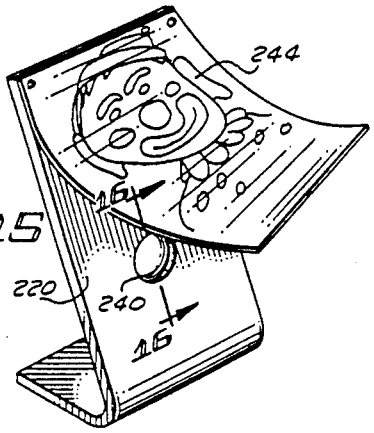
FIG. 15 illustrates an alternative embodiment of the invention in which a selected image is laminated over the front panel of the display device.
Figure 16:
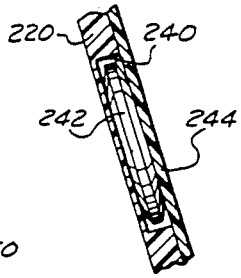
FIG. 16 is a sectional view taken through line 16—16 of FIG. 15, showing a voice wafer contained in the front panel underneath the selected image.

Another embodiment of the invention is illustrated in FIGS. 15 and 16. In this embodiment, the image area of front panel 220 is left blank, and a recess 240 is provided therein. A pressure-sensitive sound device 242 is mounted in recess 240. Sound device 242 is preferably in the form of a commercially available electronic chip known as a "Voice Wafer", which produces talking sounds or music when pressed, but a simpler sound device such as a squeaker or buzzer could also be used. A selected image 244, such as a photograph or cut-out picture of personal significance to the intended recipient of the display device, is superposed over front panel 220 and sound device 242 and bonded thereto. The display device will then be capable of producing an audible message when the recipient presses the region of image 244 overlying sound device 242.

Figure 17:
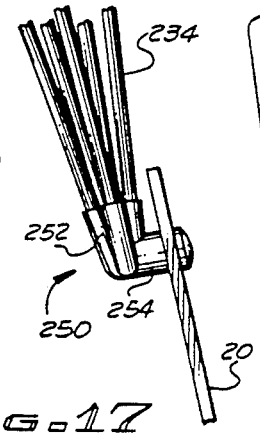
FIG. 17 illustrates an alternative arrangement for securing the rods to the front panel of the display device.
Figure 18:
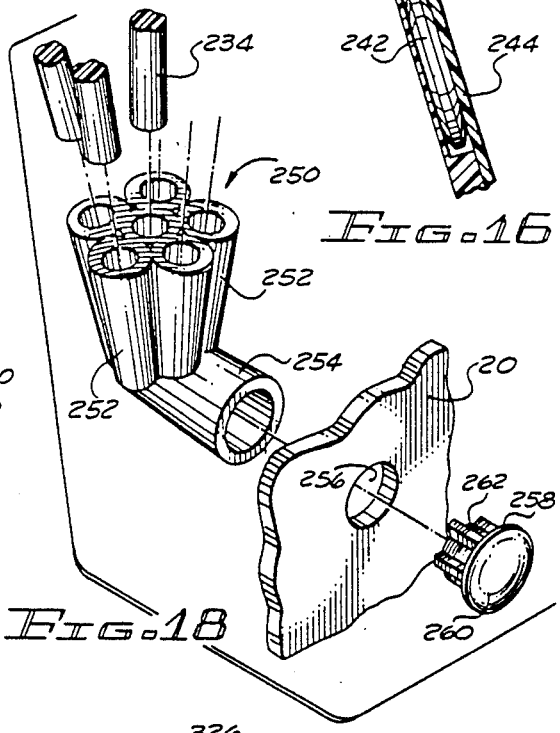
FIG. 18 is an exploded view of the arrangement shown in FIG. 17.

FIGS. 17 and 18 illustrate still another embodiment of the invention, in which a specially configured holder 250 is provided for coupling rods 34 to front panel 20 of the display device. Holder 250, which is preferably a one-piece structure formed from a rigid material such as plastic, comprises a plurality of upstanding tubes 252, each of which has an inner diameter corresponding to the outer diameter of rods 234. Tubes 252 are carried on a tubular stem 254, the longitudinal axis of which is substantially perpendicular to the longitudinal axes of tubes 252. Stem 254 is removably received in an opening 256 formed in panel 20. A plug 258, consisting of a disk member 260 having a diameter greater than the diameter of opening 256 and a cylindrical member 262 which projects from disk member 256 and fits into opening 256 of panel 20, is provided for locking stem 254 into opening 256.

One disadvantage of integrally forming the base and front panel of the display device as in the embodiments of FIGS. 12 and 13 is that the three-dimensionality of the device makes it too bulky for convenient packaging. For this reason, it may be preferable to provide the base and front panel as two separate pieces which the user couples together during assembly. This is especially advantageous when the device is marketed in the form of a "do-it-yourself" kit as shown in FIG. 5. Exemplary clips used for coupling the front panel to the base have already been described in connection with FIGS. 2, 3 and 11. Another means for coupling the front panel and base is shown in FIGS. 19 and 20.

Figure 19:
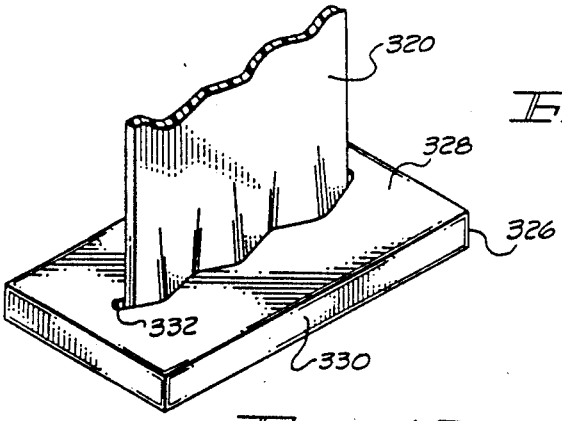
FIG. 19 illustrates another technique for coupling the base and front panels so as to support the front panel in an upright position.
Figure 20:
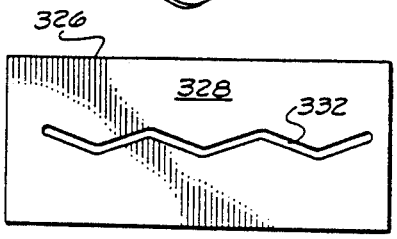
FIG. 20 is a plan view of the base shown in FIG. 19.

In the embodiment of FIGS. 19 and 20, base 326 comprises a boxlike member, preferably formed of pressed cardboard. The boxlike member has a top surface 328 and an endless sidewall 330 depending from the top surface 328. A groove or recess 332, preferably of zigzag or serpentine configuration, is formed in top surface 328. To couple front panel 320 to base 326, the lower edge of panel 320 is simply crimped and press-fit or snapped into recess 332.

The above description is given by way of example only. Changes in form and detail may be made by one skilled in the art without departing from the scope of the invention as defined by the appended claims.

I claim:

1. A display apparatus, comprising:

a front panel having an image area;

a base for maintaining said front panel in a substantially upright position;

at least one decorative appendage;

at least one rigid rod having a first end coupled to said at least one decorative appendage and a second end coupled to said front panel; and holder means for coupling said at least one rod to said front panel, said holder means including at least one tube having an inner diameter approximately equal to the diameter of said at least one rod, said tube having a longitudinal axis;

a stem secured to said tube, said stem having a longitudinal axis extending in a substantially perpendicular direction with respect to the longitudinal axis of said tube; and an opening formed in said front panel for receiving said stem.

2. A display apparatus according to claim 1, further comprising locking means for securing said stem to said front panel.

3. A display apparatus according to claim 2, wherein said stem is hollow and said locking means comprises a plug member including:

a disk member having a diameter greater than the diameter of said opening, and a cylindrical member projecting from said disk member for insertion into the hollow interior of said stem.

* * * * *

UNITED STATES PATENT AND TRADEMARK OFFICE

CERTIFICATE OF CORRECTION

PATENT NO. : 5,024,011

DATED : June 18, 1991

INVENTOR(S) : Dane H. Collins

It is certified that error appears in the above-identified patent and that said Letters Patent is hereby corrected as shown below:

On drawing sheet 3, in the proximity of Fig. 13, delete what appears to be a hand notation best described as "D17".

Signed and Sealed this

Sixth Day of October, 1992

*Attest:*

DOUGLAS B. COMER

*Attesting Officer*

*Acting Commissioner of Patents and Trademarks*